US010389041B2

(12) United States Patent
Yoon et al.

(10) Patent No.: US 10,389,041 B2
(45) Date of Patent: Aug. 20, 2019

(54) PHASED ARRAY ANTENNA PANEL WITH ENHANCED ISOLATION AND REDUCED LOSS

(71) Applicant: Movandi Corporation, Newport Beach, CA (US)

(72) Inventors: Seunghwan Yoon, Irvine, CA (US); Alfred Grau Besoli, Irvine, CA (US); Ahmadreza Rofougaran, Newport Coast, CA (US); Farid Shirinfar, Granada Hills, CA (US); Sam Gharavi, Irvine, CA (US); Michael Boers, South Turramurra (AU); Maryam Rofougaran, Rancho Palos Verdes, CA (US)

(73) Assignee: Movandi Corporation, Newport Beach, CA (US)

( * ) Notice: Subject to any disclaimer, the term of this patent is extended or adjusted under 35 U.S.C. 154(b) by 312 days.

(21) Appl. No.: 15/355,967

(22) Filed: Nov. 18, 2016

(65) Prior Publication Data

US 2018/0145421 A1 May 24, 2018

(51) Int. Cl.

| | |
|---|---|
| ***H01Q 21/06*** | (2006.01) |
| ***H01Q 1/52*** | (2006.01) |
| ***H01Q 21/24*** | (2006.01) |
| *H01Q 1/22* | (2006.01) |
| *H01Q 3/26* | (2006.01) |
| *H01Q 21/00* | (2006.01) |
| *H01Q 25/00* | (2006.01) |

(52) U.S. Cl.

CPC ..... *H01Q 21/065* (2013.01); *H01Q 1/523* (2013.01); *H01Q 21/24* (2013.01); *H01Q 1/2283* (2013.01); *H01Q 3/26* (2013.01); *H01Q 21/0006* (2013.01); *H01Q 25/001* (2013.01)

(58) Field of Classification Search

CPC ..... H01Q 21/065; H01Q 21/24; H01Q 1/523; H01Q 25/001; H01Q 21/0006; H01Q 3/26; H01Q 1/2283

USPC ..... 455/562.1

See application file for complete search history.

(56) References Cited

U.S. PATENT DOCUMENTS 5,708,444 A * 1/1998 Pouwels ..... H01Q 9/0457 343/700 MS 8,618,983 B2 12/2013 Chen

* cited by examiner

*Primary Examiner* — Eugene Yun

(74) *Attorney, Agent, or Firm* — Farjami & Farjami LLP

(57) ABSTRACT

A phased array antenna panel includes a central radio frequency (RF) front end chip, neighboring RF front end chips, and an antenna. The antenna has a proximal probe and a distal probe. The proximal probe has one end at a near corner of the antenna adjacent to the central RF front end chip, and reduces an insertion loss in signals processed by the central RF front end chip. The distal probe has one end at a far corner of the antenna adjacent to one of the neighboring RF front end chips, and increases the isolation between signals processed by the central RF front end chip and signals processed by the one of the neighboring RF front end chips.

10 Claims, 5 Drawing Sheets

PHASED ARRAY ANTENNA PANEL WITH ENHANCED ISOLATION AND REDUCED LOSS

RELATED APPLICATION(S)

The present application is related to U.S. patent application Ser. No. 15/225,071, filed on Aug. 1, 2016, and titled "Wireless Receiver with Axial Ratio and Cross-Polarization Calibration," and U.S. patent application Ser. No. 15/225,523, filed on Aug. 1, 2016, and titled "Wireless Receiver with Tracking Using Location, Heading, and Motion Sensors and Adaptive Power Detection," and U.S. patent application Ser. No. 15/226,785, filed on Aug. 2, 2016, and titled "Large Scale Integration and Control of Antennas with Master Chip and Front End Chips on a Single Antenna Panel," and U.S. patent application Ser. No. 15/255,656, filed on Sep. 2, 2016, and titled "Novel Antenna Arrangements and Routing Configurations in Large Scale Integration of Antennas with Front End Chips in a Wireless Receiver," and U.S. patent application Ser. No. 15/256,038 filed on Sep. 2, 2016, and titled "Transceiver Using Novel Phased Array Antenna Panel for Concurrently Transmitting and Receiving Wireless Signals," and U.S. patent application Ser. No. 15/256,222 filed on Sep. 2, 2016, and titled "Wireless Transceiver Having Receive Antennas and Transmit Antennas with Orthogonal Polarizations in a Phased Array Antenna Panel," and U.S. patent application Ser. No. 15/278,970 filed on Sep. 28, 2016, and titled "Low-Cost and Low-Loss Phased Array Antenna Panel," and U.S. patent application Ser. No. 15/279,171 filed on Sep. 28, 2016, and titled "Phased Array Antenna Panel Having Cavities with RF Shields for Antenna Probes," and U.S. patent application Ser. No. 15/279,219 filed on Sep. 28, 2016, and titled "Phased Array Antenna Panel Having Quad Split Cavities Dedicated to Vertical-Polarization and Horizontal-Polarization Antenna Probes," and U.S. patent application Ser. No. 15/335,034 filed on Oct. 26, 2016, and titled "Lens-Enhanced Phased Array Antenna Panel," and U.S. patent application Ser. No. 15/335,179 filed on Oct. 26, 2016, and titled "Phased Array Antenna Panel with Configurable Slanted Antenna Rows." The disclosures of all of these related applications are hereby incorporated fully by reference into the present application.

BACKGROUND

Phased array antenna panels with large numbers of antennas and front end chips integrated on a single board are being developed in view of higher wireless communication frequencies being used between a satellite transmitter and a wireless receiver, and also more recently in view of higher frequencies used in the evolving 5G wireless communications (5th generation mobile networks or 5th generation wireless systems). Phased array antenna panels are capable of beamforming by phase shifting and amplitude control techniques, and without physically changing direction or orientation of the phased array antenna panels, and without a need for mechanical parts to effect such changes in direction or orientation.

Phased array antenna panels often require antennas to be capable of transmitting or receiving signals while there are other antennas in the phased array in close proximity, resulting in poor signal isolation between signals received from or transmitted by the various antennas in the phased array. Increasing the separation between antennas or employing specialized isolation techniques can improve signal isolation. However, due to increased cost, size and complexity of the phased array, these approaches can be impractical. In addition, because of the high-loss nature of wireless communication signals, energy loss occurs between antennas and front end chips processing the signals to be received from or transmitted by the antennas. Thus, there is a need in the art for large scale integration of phased array antenna panels with increased signal isolation and reduced signal loss.

SUMMARY

The present disclosure is directed to a phased array antenna panel with increased signal isolation and reduced signal loss, substantially as shown in and/or described in connection with at least one of the figures, and as set forth in the claims

DETAILED DESCRIPTION

Figure 1A:
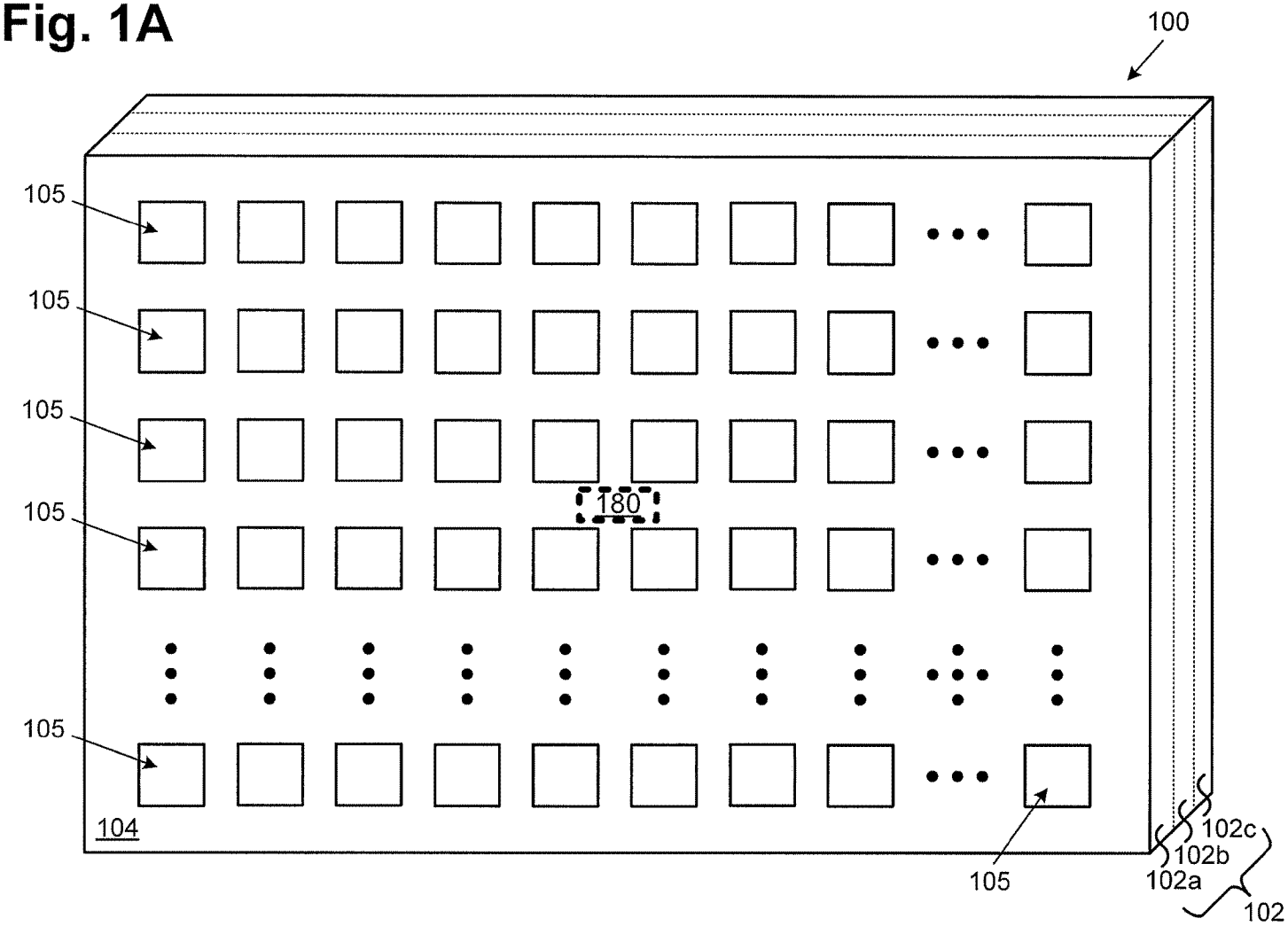
FIG. 1A illustrates a perspective view of a portion of an exemplary phased array antenna panel according to one implementation of the present application.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1A illustrates a perspective view of a portion of an exemplary phased array antenna panel according to one implementation of the present application. As illustrated in FIG. 1A, phased array antenna panel 100 includes substrate 102 having layers 102*a*, 102*b*, and 102*c*, front surface 104 having front end units 105, and master chip 180. In the present implementation, substrate 102 may be a multi-layer printed circuit board (PCB) having layers 102*a*, 102*b*, and 102*c*. Although only three layers are shown in FIG. 1A, in another implementation, substrate 102 may be a multi-layer PCB having greater or fewer than three layers.

As illustrated in FIG. 1A, front surface 104 having front end units 105 is formed on top layer 102*a* of substrate 102. In one implementation, substrate 102 of phased array antenna panel 100 may include 500 front end units 105, each having a radio frequency (RF) front end chip connected to a plurality of antennas (not explicitly shown in FIG. 1A). In one implementation, phased array antenna panel 100 may include 2000 antennas on front surface 104, where each front end unit 105 includes four antennas connected to an RF front end chip (not explicitly shown in FIG. 1A).

In the present implementation, master chip 180 may be formed in layer 102*c* of substrate 102, where master chip 180 may be connected to front end units 105 on top layer 102*a* using a plurality of control and data buses (not explicitly shown in FIG. 1A) routed through various layers of substrate 102. In the present implementation, master chip 180 is configured to provide phase shift and amplitude control signals from a digital core in master chip 180 to the RF front end chips in each of front end units 105 based on signals received from the antennas in each of front end units 105.

Figure 1B:
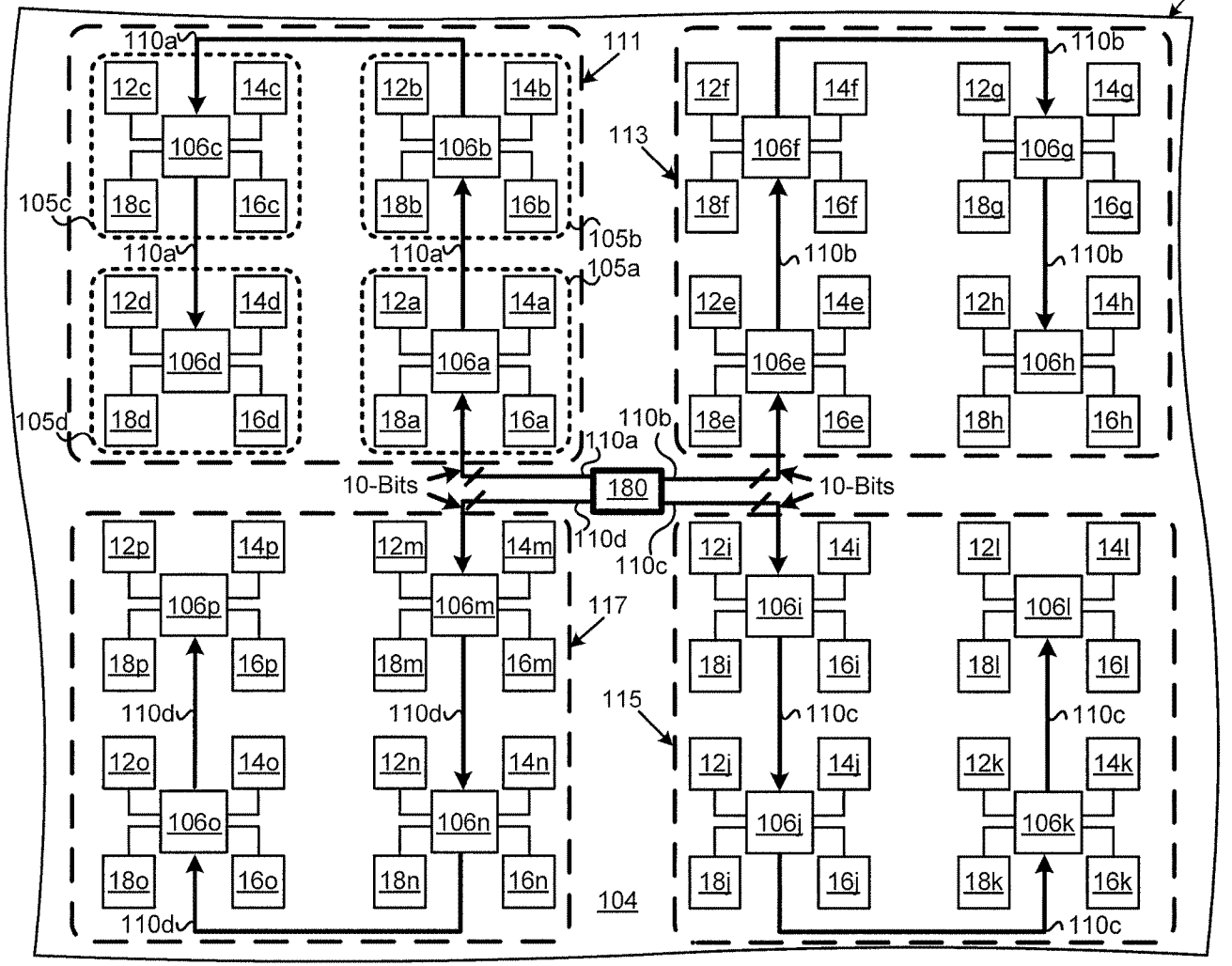
FIG. 1B illustrates a layout diagram of a portion of an exemplary phased array antenna panel according to one implementation of the present application.

FIG. 1B illustrates a layout diagram of a portion of an exemplary phased array antenna panel according to one implementation of the present application. For example, layout diagram 190 illustrates a layout of a simplified phased array antenna panel on a single printed circuit board (PCB), where master chip 180 is configured to drive in parallel four control and data buses, e.g., control and data buses 110*a*, 110*b*, 110*c*, and 110*d*, where each control and data bus is coupled to a respective antenna segment, e.g., antenna segments 111, 113, 115, and 117, where each antenna segment has four front end units, e.g., front end units 105*a*, 105*b*, 105*c*, and 105*d* in antenna segment 111, where each front end unit includes an RF front end chip, e.g., RF front end chip 106*a* in front end unit 105*a*, and where each RF front end chip is coupled to four antennas, e.g., antennas 12*a*, 14*a*, 16*a*, and 18*a* coupled to RF front end chip 106*a* in front end unit 105*a*.

As illustrated in FIG. 1B, front surface 104 includes antennas 12*a* through 12*p*, 14*a* through 14*p*, 16*a* through 16*p*, and 18*a* through 18*p*, collectively referred to as antennas 12-18. In one implementation, antennas 12-18 may be configured to receive and/or transmit signals from and/or to one or more commercial geostationary communication satellites or low earth orbit satellites.

In one implementation, for a wireless transmitter transmitting signals at 10 GHz (i.e., $\lambda$=30 mm), each antenna needs an area of at least a quarter wavelength (i.e., $\lambda/4$=7.5 mm) by a quarter wavelength (i.e., $\lambda/4$=7.5 mm) to receive the transmitted signals. As illustrated in FIG. 1B, antennas 12-18 in front surface 104 may each have a square shape having dimensions of 7.5 mm by 7.5 mm, for example. In one implementation, each adjacent pair of antennas 12-18 may be separated by a distance of a multiple integer of the quarter wavelength (i.e., $n*\lambda/4$), such as 7.5 mm, 15 mm, 22.5 mm and etc. In general, the performance of the phased array antenna panel improves with the number of antennas 12-18 on front surface 104.

In the present implementation, the phased array antenna panel is a flat panel array employing antennas 12-18, where antennas 12-18 are coupled to associated active circuits to form a beam for reception (or transmission). In one implementation, the beam is formed fully electronically by means of phase control devices associated with antennas 12-18. Thus, phased array antenna panel 100 can provide fully electronic beamforming without the use of mechanical parts.

As illustrated in FIG. 1B, RF front end chips 106*a* through 106*p*, and antennas 12*a* through 12*p*, 14*a* through 14*p*, 16*a* through 16*p*, and 18*a* through 18*p*, are divided into respective antenna segments 111, 113, 115, and 117. As further illustrated in FIG. 1B, antenna segment 111 includes front end unit 105*a* having RF front end chip 106*a* coupled to antennas 12*a*, 14*a*, 16*a*, and 18*a*, front end unit 105*b* having RF front end chip 106*b* coupled to antennas 12*b*, 14*b*, 16*b*, and 18*b*, front end unit 105*c* having RF front end chip 106*c* coupled to antennas 12*c*, 14*c*, 16*c*, and 18*c*, and front end unit 105*d* having RF front end chip 106*d* coupled to antennas 12*d*, 14*d*, 16*d*, and 18*d*. Antenna segment 113 includes similar front end units having RF front end chip 106*e* coupled to antennas 12*e*, 14*e*, 16*e*, and 18*e*, RF front end chip 106*f* coupled to antennas 12*f*, 14*f*, 16*f*, and 18*f*, RF front end chip 106*g* coupled to antennas 12*g*, 14*g*, 16*g*, and 18*g*, and RF front end chip 106*h* coupled to antennas 12*h*, 14*h*, 16*h*, and 18*h*. Antenna segment 115 also includes similar front end units having RF front end chip 106*i* coupled to antennas 12*i*, 14*i*, 16*i*, and 18*i*, RF front end chip 106*j* coupled to antennas 12*j*, 14*j*, 16*j*, and 18*j*, RF front end chip 106*k* coupled to antennas 12*k*, 14*k*, 16*k*, and 18*k*, and RF front end chip 106*l* coupled to antennas 12*l*, 14*l*, 16*l*, and 18*l*. Antenna segment 117 also includes similar front end units having RF front end chip 106*m* coupled to antennas 12*m*, 14*m*, 16*m*, and 18*m*, RF front end chip 106*n* coupled to antennas 12*n*, 14*n*, 16*n*, and 18*n*, RF front end chip 106*o* coupled to antennas 12*o*, 14*o*, 16*o*, and 18*o*, and RF front end chip 106*p* coupled to antennas 12*p*, 14*p*, 16*p*, and 18*p*.

As illustrated in FIG. 1B, master chip 108 is configured to drive in parallel control and data buses 110*a*, 110*b*, 110*c*, and 110*d* coupled to antenna segments 111, 113, 115, and 117, respectively. For example, control and data bus 110*a* is coupled to RF front end chips 106*a*, 106*b*, 106*c*, and 106*d* in antenna segment 111 to provide phase shift signals and amplitude control signals to the corresponding antennas coupled to each of RF front end chips 106*a*, 106*b*, 106*c*, and 106*d*. Control and data buses 110*b*, 110*c*, and 110*d* are configured to perform similar functions as control and data bus 110*a*. In the present implementation, master chip 180 and antenna segments 111, 113, 115, and 117 having RF front end chips 106*a* through 106*p* and antennas 12-18 are all integrated on a single printed circuit board.

It should be understood that layout diagram 190 in FIG. 1B is intended to show a simplified phased array antenna panel according to the present inventive concepts. In one implementation, master chip 180 may be configured to control a total of 2000 antennas disposed in ten antenna segments. In this implementation, master chip 180 may be configured to drive in parallel ten control and data buses, where each control and data bus is coupled to a respective antenna segment, where each antenna segment has a set of 50 RF front end chips and a group of 200 antennas are in each antenna segment; thus, each RF front end chip is coupled to four antennas. Even though this implementation describes each RF front end chip coupled to four antennas, this implementation is merely an example. An RF front end chip may be coupled to any number of antennas, particularly a number of antennas ranging from three to sixteen.

Figure 2:
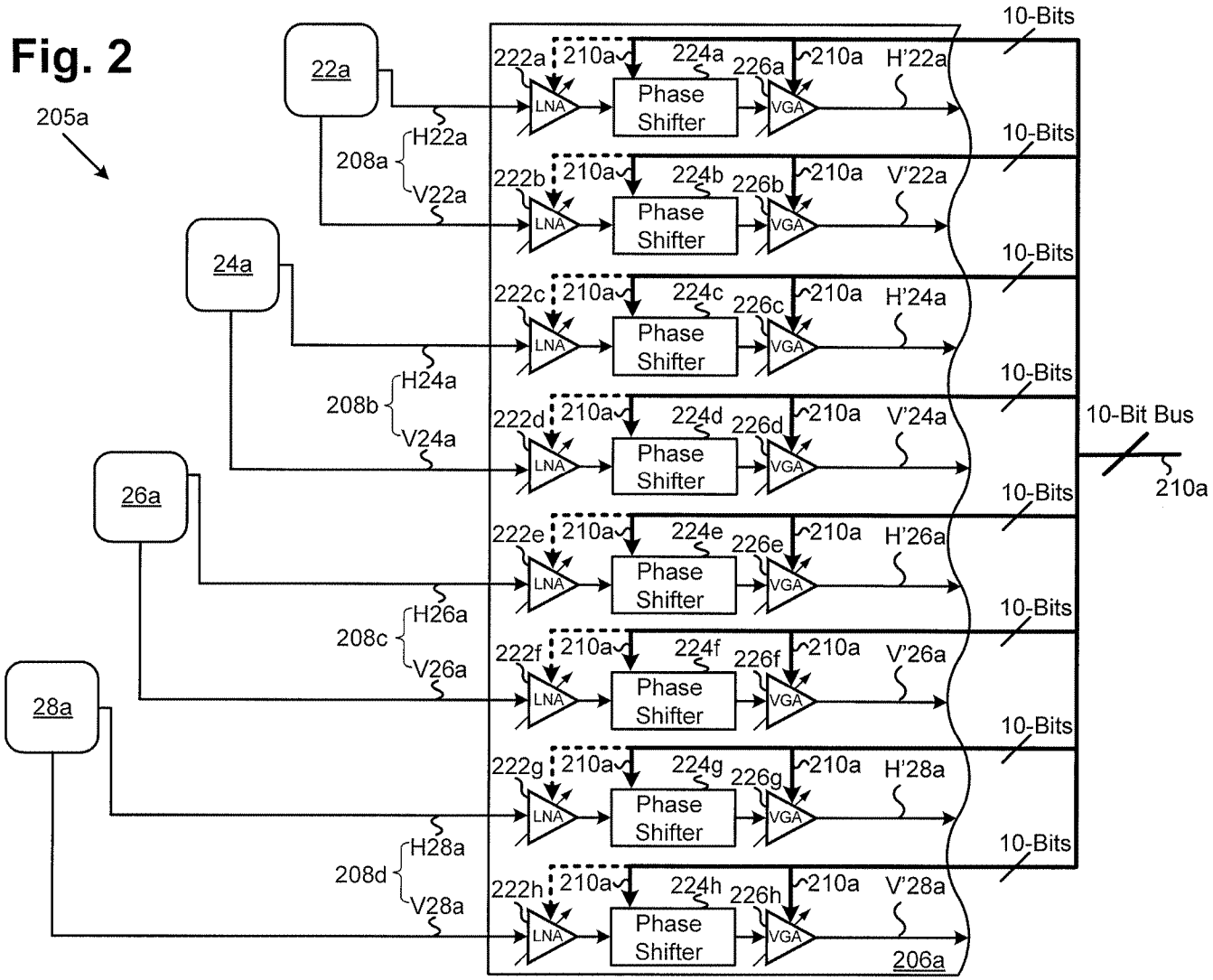
FIG. 2 illustrates a functional block diagram of a portion of an exemplary phased array antenna panel according to one implementation of the present application.

FIG. 2 illustrates a functional block diagram of a portion of an exemplary phased array antenna panel according to one implementation of the present application. In the present implementation, front end unit 205*a* may correspond to front end unit 105*a* in FIG. 1B of the present application. As illustrated in FIG. 2, front end unit 205*a* includes antennas 22*a*, 24*a*, 26*a*, and 28*a* coupled to RF front end chip 206*a*, where antennas 22*a*, 24*a*, 26*a*, and 28*a* and RF front end chip 206*a* may correspond to antennas 12*a*, 14*a*, 16*a*, and 18*a* and RF front end chip 106*a*, respectively, in FIG. 1B.

In the present implementation, antennas 22*a*, 24*a*, 26*a*, and 28*a* may be configured to receive signals from one or more commercial geostationary communication satellites, for example, which typically employ circularly polarized or linearly polarized signals defined at the satellite with a horizontally-polarized (H) signal having its electric-field oriented parallel with the equatorial plane and a vertically-polarized (V) signal having its electric-field oriented perpendicular to the equatorial plane. As illustrated in FIG. 2, each of antennas 22*a*, 24*a*, 26*a*, and 28*a* is configured to provide an H output and a V output to RF front end chip 206*a*.

For example, antenna 22*a* provides linearly polarized signal 208*a*, having horizontally-polarized signal H22*a* and vertically-polarized signal V22*a*, to RF front end chip 206*a*. Antenna 24*a* provides linearly polarized signal 208*b*, having horizontally-polarized signal H24*a* and vertically-polarized signal V24*a*, to RF front end chip 206*a*. Antenna 26*a* provides linearly polarized signal 208*c*, having horizontally-polarized signal H26*a* and vertically-polarized signal V26*a*, to RF front end chip 206*a*. Antenna 28*a* provides linearly polarized signal 208*d*, having horizontally-polarized signal H28*a* and vertically-polarized signal V28*a*, to RF front end chip 206*a*.

As illustrated in FIG. 2, horizontally-polarized signal H22*a* from antenna 22*a* is provided to a receiving chip having low noise amplifier (LNA) 222*a*, phase shifter 224*a* and variable gain amplifier (VGA) 226*a*, where LNA 222*a* is configured to generate an output to phase shifter 224*a*, and phase shifter 224*a* is configured to generate an output to VGA 226*a*. In addition, vertically-polarized signal V22*a* from antenna 22*a* is provided to a receiving chip including low noise amplifier (LNA) 222*b*, phase shifter 224*b* and variable gain amplifier (VGA) 226*b*, where LNA 222*b* is configured to generate an output to phase shifter 224*b*, and phase shifter 224*b* is configured to generate an output to VGA 226*b*.

As shown in FIG. 2, horizontally-polarized signal H24*a* from antenna 24*a* is provided to a receiving chip having low noise amplifier (LNA) 222*c*, phase shifter 224*c* and variable gain amplifier (VGA) 226*c*, where LNA 222*c* is configured to generate an output to phase shifter 224*c*, and phase shifter 224*c* is configured to generate an output to VGA 226*c*. In addition, vertically-polarized signal V24*a* from antenna 24*a* is provided to a receiving chip including low noise amplifier (LNA) 222*d*, phase shifter 224*d* and variable gain amplifier (VGA) 226*d*, where LNA 222*d* is configured to generate an output to phase shifter 224*d*, and phase shifter 224*d* is configured to generate an output to VGA 226*d*.

As illustrated in FIG. 2, horizontally-polarized signal H26*a* from antenna 26*a* is provided to a receiving chip having low noise amplifier (LNA) 222*e*, phase shifter 224*e* and variable gain amplifier (VGA) 226*e*, where LNA 222*e* is configured to generate an output to phase shifter 224*e*, and phase shifter 224*e* is configured to generate an output to VGA 226*e*. In addition, vertically-polarized signal V26*a* from antenna 26*a* is provided to a receiving chip including low noise amplifier (LNA) 222*f*, phase shifter 224*f* and variable gain amplifier (VGA) 226*f*, where LNA 222*f* is configured to generate an output to phase shifter 224*f*, and phase shifter 224*f* is configured to generate an output to VGA 226*f*.

As further shown in FIG. 2, horizontally-polarized signal H28*a* from antenna 28*a* is provided to a receiving chip having low noise amplifier (LNA) 222*g*, phase shifter 224*g* and variable gain amplifier (VGA) 226*g*, where LNA 222*g* is configured to generate an output to phase shifter 224*g*, and phase shifter 224*g* is configured to generate an output to VGA 226*g*. In addition, vertically-polarized signal V28*a* from antenna 28*a* is provided to a receiving chip including low noise amplifier (LNA) 222*h*, phase shifter 224*h* and variable gain amplifier (VGA) 226*h*, where LNA 222*h* is configured to generate an output to phase shifter 224*h*, and phase shifter 224*h* is configured to generate an output to VGA 226*h*.

As further illustrated in FIG. 2, control and data bus 210*a*, which may correspond to control and data bus 110*a* in FIG. 1B, is provided to RF front end chip 206*a*, where control and data bus 210*a* is configured to provide phase shift signals to phase shifters 224*a*, 224*b*, 224*c*, 224*d*, 224*e*, 224*f*, 224*g*, and 224*h* in RF front end chip 206*a* to cause a phase shift in at least one of these phase shifters, and to provide amplitude control signals to VGAs 226*a*, 226*b*, 226*c*, 226*d*, 226*e*, 226*f*, 226*g*, and 226*h*, and optionally to LNAs 222*a*, 222*b*, 222*c*, 222*d*, 222*e*, 222*f*, 222*g*, and 222*h* in RF front end chip 206*a* to cause an amplitude change in at least one of the linearly polarized signals received from antennas 22*a*, 24*a*, 26*a*, and 28*a*. It should be noted that control and data bus 210*a* is also provided to other front end units, such as front end units 105*b*, 105*c*, and 105*d* in segment 111 of FIG. 1B. In one implementation, at least one of the phase shift signals carried by control and data bus 210*a* is configured to cause a phase shift in at least one linearly polarized signal, e.g., horizontally-polarized signals H22*a* through H28*a* and vertically-polarized signals V22*a* through V28*a*, received from a corresponding antenna, e.g., antennas 22*a*, 24*a*, 26*a*, and 28*a*.

In one implementation, amplified and phase shifted horizontally-polarized signals H'22*a*, H'24*a*, H'26*a*, and H'28*a* in front end unit 205*a*, and other amplified and phase shifted horizontally-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide an H-combined output to a master chip such as master chip 180 in FIG. 1. Similarly, amplified and phase shifted vertically-polarized signals V'22*a*, V'24*a*, V'26*a*, and V'28*a* in front end unit 205*a*, and other amplified and phase shifted vertically-polarized signals from the other front end units, e.g. front end units 105*b*, 105*c*, and 105*d* as well as front end units in antenna segments 113, 115, and 117 shown in FIG. 1B, may be provided to a summation block (not explicitly shown in FIG. 2), that is configured to sum all of the powers of the amplified and phase shifted horizontally-polarized signals, and combine all of the phases of the amplified and phase shifted horizontally-polarized signals, to provide a V-combined output to a master chip such as master chip 180 in FIG. 1.

Figure 3:
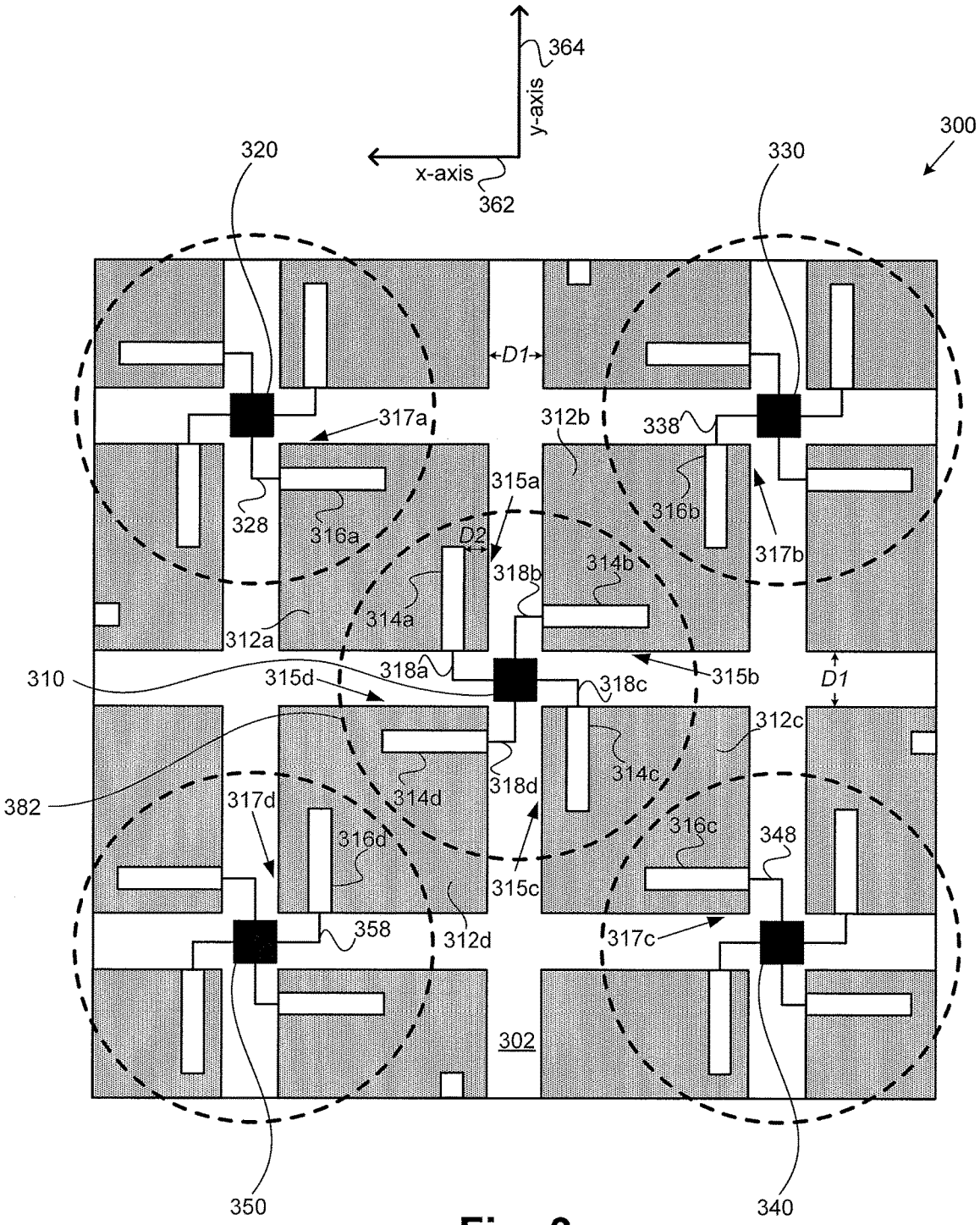
FIG. 3 illustrates a top view of a portion of an exemplary phased array antenna panel according to one implementation of the present application.

FIG. 3 illustrates a top view of a portion of an exemplary phased array antenna panel according to one implementation of the present application. As illustrated in FIG. 3, exemplary phased array antenna panel 300 includes substrate 302, central RF front end chip 310, neighboring front end chips 320, 330, 340, and 350, and antennas 312*a*, 312*b*, 312*c*, and 312*d*, collectively referred to as antennas 312, having respective proximal probes 314*a*, 314*b*, 314*c*, and 314*d*, collectively referred to as proximal probes 314, respective distal probes 316*a*, 316*b*, 316*c*, and 316*d*, collectively referred to as distal probes 316, respective near antenna corners 315*a*, 315*b*, 315*c*, and 315*d*, collectively referred to as near antenna corners 315, and respective far antenna corners 317*a*, 317*b*, 317*c*, and 317*d*, collectively referred to as far antenna corners 317. Some features discussed in conjunction with the layout diagram of FIG. 1B, such as a master chip and control and data buses are omitted in FIG. 3 for the purposes of clarity.

As illustrated in FIG. 3, antennas 312 are arranged on the top surface of substrate 302. In the present example, antennas 312 have substantially square shapes, or substantially rectangular shapes, and are aligned with each other. In this example, the distance between each antenna and an adjacent antenna is a fixed distance. As illustrated in the example of FIG. 3, fixed distance D1 separates various adjacent antennas, such as antenna 312*b* from adjacent antennas 312*a* and 312*c*. In one implementation, distance D1 may be a quarter wavelength (i.e., $\lambda/4$). Antennas 312 may be, for example, cavity antennas or patch antennas or other types of antennas. The shape of antennas 312 may correspond to, for example, the shape of an opening in a cavity antenna or the shape of an antenna plate in a patch antenna. In other implementations, antennas 312 may have substantially circular shapes, or may have any other shapes. In some implementations, some of antennas 312 may be offset rather than aligned. In various implementations, distance D1 may be less than or greater than a quarter wavelength (i.e., less than or greater than $\lambda/4$), or the distance between each antenna and an adjacent antenna might not be a fixed distance.

As further illustrated in FIG. 3, central RF front end chip 310 and neighboring RF front end chips 320, 330, 340, and 350 are arranged on the top surface of substrate 302. Central RF front end chip 310 is adjacent to near antenna corners 315 of antennas 312. Neighboring RF front end chips 320, 330, 340, and 350 are adjacent to respective far antenna corners 317*a*, 317*b*, 317*c*, and 317*d* of respective antennas 312*a*, 312*b*, 312*c*, and 312*d*. Thus, each of antennas 312 is adjacent to two RF front end chips, one neighboring RF front end chip and the central RF front end chip 310, and central RF front end chip 310 is adjacent to four antennas 312. Although the present application refers to "central" RF front end chip 310, the term "central" does not necessarily mean that RF front end chip 310 is (or is required to be) precisely and mathematically centered; the term "central" is used merely as a short-hand reference and for convenience to refer to an RF front chip that is situated between other RF front end chips (which are also referred to as "neighboring RF front end chips" in the present application). Central RF front end chip 310 may be substantially centered or generally between neighboring RF front end chips 320, 330, 340, and 350. In other implementations, central RF front end chip 310 may be between a number of neighboring RF front end chips that is fewer than four or greater than four.

FIG. 3 illustrates proximal probes 314 and distal probes 316 disposed in antennas 312. Proximal probes 314*a*, 314*b*, 314*c*, and 314*d* each have one end at respective near antenna corners 315*a*, 315*b*, 315*c*, and 315*d* adjacent to central RF front end chip 310. Proximal probes 314*a*, 314*b*, 314*c*, and 314*d* each have another end extending into respective antennas 312*a*, 312*b*, 312*c*, and 312*d*, away from central RF front end chip 310. Distal probes 316*a*, 316*b*, 316*c*, and 316*d* each have one end at respective far antenna corners 317*a*, 317*b*, 317*c*, and 317*d* adjacent to respective neighboring RF front end chips 320, 330, 340, and 350. Distal probes 316*a*, 316*b*, 316*c*, and 316*d* each have another end extending into respective antennas 312*a*, 312*b*, 312*c*, and 312*d*, away from respective neighboring RF front end chips 320, 330, 340, and 350. Although the present application refers to proximal probes 314 and distal probes 316, the terminology is relative rather than absolute. In the present example, RF front end chip 310 is a central RF front end chip, thus probe 314*a* is a proximal probe and probe 316*a* is a distal probe. However, in a different example, RF front end chip 320 may be considered a central RF front end chip, thus, probe 316*a* would be a proximal probe and probe 314*a* would be a distal probe. In FIG. 3, the dashed circles, such as dashed circle 382, surround each RF front end chip and its relative proximal probes.

As illustrated in FIG. 3, proximal probes 314 and distal probes 316 are arranged at near antenna corners 315 and far antenna corners 317 respectively, but may or may not be completely flush with near antenna corners 315 and far antenna corners 317. For example, in antenna 312*a*, distance D2 may separate proximal probe 314*a* from near antenna corner 315*a*, and separates distal probe 316*a* from far antenna corner 317*a*. Distance D2 may be, for example, a distance that allows tolerance during production or alignment of proximal probes 314 and distal probes 316. Distance D2 may be designed so as to reduce the distance between central RF front end chip 310 and proximal probes 314, or between neighboring RF front end chips 320, 330, 340, and 350 and distal probes 316. In one example, the distance between central RF front end chip 310 and proximal probes 314 may be less than approximately 2 millimeters.

FIG. 3 further illustrates exemplary orientations of an x-axis (e.g., x-axis 362) and a perpendicular, or substantially perpendicular, y-axis (e.g., y-axis 364). Antennas 312*a* and 312*c* have respective proximal probes 314*a* and 314*c* parallel to the y-axis, and respective distal probes 316*a* and 316*c* parallel to the x-axis. Antennas 312*b* and 312*d* have respective proximal probes 314*b* and 314*d* parallel to the x-axis, and respective distal probes 316*b* and 316*d* parallel to the y-axis. Probes parallel to the x-axis may be configured to receive or transmit horizontally-polarized signals. Probes parallel to the y-axis may be configured to receive or transmit vertically-polarized signals. Thus, each of antennas 312 may be configured to receive or transmit two polarized signals, one horizontally-polarized signal and one vertically-polarized signal, as stated above.

FIG. 3 further shows electrical connectors 318*a*, 318*b*, 318*c*, and 318*d*, collectively referred to as electrical connectors 318, coupling respective proximal probes 314*a*, 314*b*, 314*c*, and 314*d* to central RF front end chip 310. Electrical connectors 318 may be, for example, traces in substrate 302. Electrical connectors 318 provide signals between proximal probes 314 of antennas 312 and central RF front end chip 310. As stated above, a master chip (not shown in FIG. 3) may provide phase shift and amplitude control signals to antennas 312 through central RF front end chip 310. By arranging proximal probes 314 of antennas 312 at near antenna corners 315 adjacent to central RF front end chip 310, phased array antenna panel 300 reduces insertion loss between antennas 312 and central RF front end chip 310 processing the signals to be received from or transmitted by antennas 312. Thus, when employing a large number of antennas, phased array antenna panel 300 achieves reduced energy loss.

FIG. 3 further illustrates electrical connectors 328, 338, 348, and 358, coupling respective distal probes 316*a*, 316*b*, 316*c*, and 316*d* to respective neighboring RF front end chips 320, 330, 340, and 350. Electrical connectors 328, 338, 348, and 358, may be, for example, traces in substrate 302. Electrical connectors 328, 338, 348, and 358 provide signals between distal probes 316 of antennas 312 and neighboring RF front end chips 320, 330, 340, and 350. By arranging distal probes 316 of antennas 312 at far antenna corners 317 adjacent to neighboring RF front end chips 320, 330, 340, and 350, probes within a single antenna are physically distanced from each other while receiving or transmitting signals. In addition, by arranging distal probes 316 of antennas 312 at far antenna corners 317 adjacent to neighboring RF front end chips 320, 330, 340, and 350, probes within a single antenna can receive signals from or transmit signals to different RF front end chips. For example, distal probe 316*a* of antenna 312*a* can receive a horizontally-polarized signal from neighboring RF front end chip 320, while proximal probe 314*a* of antenna 312*a* can receive a vertically-polarized signal from central RF front end chip 310. Thus, phased array antenna panel 300 achieves increased the isolation between those signals.

Figure 4:
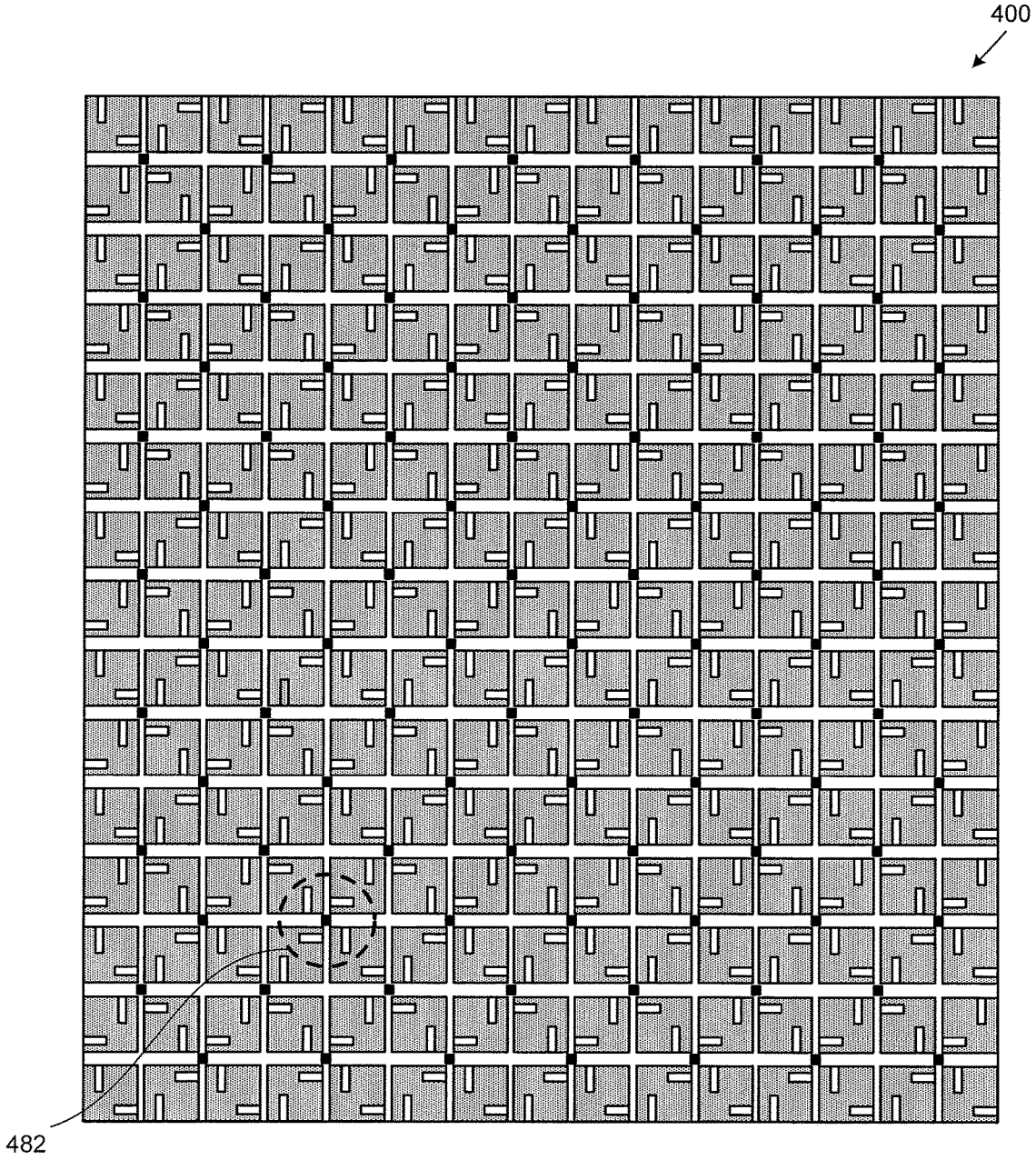
FIG. 4 illustrates a top view of a portion of an exemplary phased array antenna panel according to one implementation of the present application.

FIG. 4 illustrates a top view of a portion of an exemplary phased array antenna panel according to one implementation of the present application. FIG. 4 illustrates a large-scale implementation of the present application. Numerous antennas, RF front end chips, and their corresponding probes are arranged on phased array antenna panel 400. Dashed circle 482 in FIG. 4 may correspond to dashed circle 382 in FIG. 3, which encloses four proximal probes 314*a*, 314*b*, 314*c*, and 314*d*. In one example, phased array antenna panel 400 may be a substantially square module having dimensions of eight inches by eight inches (i.e., 8 in.×8 in). In other implementations, phased array antenna panel module may have any other shape or dimensions. The various implementations and examples of antennas, electrical connectors, probes, and distances in relation to any elements discussed in FIG. 3 may also apply to the large-scale implementation shown in phased array antenna panel 400 in FIG. 4.

Thus, various implementations of the present application result in an increased signal isolation and reduced signal loss in the phased array antenna panel without increasing cost, size, and complexity of the phased array antennal panel.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

The invention claimed is:

1. A phased array antenna panel comprising:

a central radio frequency (RF) front end chip and neighboring RF front end chips;

an antenna having a proximal probe and a distal probe;

said proximal probe having one end at a near antenna corner adjacent to said central RF front end chip and said distal probe having one end at a far antenna corner adjacent to one of said neighboring RF front end chips;

said proximal probe being in an x-axis, and said distal probe being in a y-axis that is substantially perpendicular to said x-axis.

2. The phased array antenna panel of claim 1, wherein said antenna provides a reduced insertion loss in signals processed by said central RF front end chip.

3. The phased array antenna panel of claim 1, wherein said antenna provides an increased isolation between signals processed by said central RF front end chip and signals processed by said neighboring RF front end chips.

4. The phased array antenna panel of claim 1, wherein said central RF front end chip is coupled to said proximal probe.

5. The phased array antenna panel of claim 1, wherein said one of said neighboring RF front end chips is coupled to said distal probe.

6. The phased array antenna panel of claim 1, further comprising a master chip, wherein said master chip provides phase shift signals for said antenna through said central RF front end chip.

7. The phased array antenna panel of claim 1, further comprising a master chip, wherein said master chip provides amplitude control signals for said antenna through said central RF front end chip.

8. The phased array antenna panel of claim 1, wherein said antenna comprises a cavity antenna.

9. The phased array antenna panel of claim 1, wherein said antenna comprises a patch antenna.

10. The phased array antenna panel of claim 1, wherein a distance between said central RF front end chip and said one end of said proximal probe and is less than approximately 2 millimeters.

* * * * *